United States Patent [19]

Moore

[11] Patent Number: 4,561,577

[45] Date of Patent: Dec. 31, 1985

[54] KNIFE HOLSTER

[76] Inventor: Thomas L. Moore, P.O. Box 172, Higganum, Conn. 06441

[21] Appl. No.: 649,752

[22] Filed: Sep. 12, 1984

[51] Int. Cl.[4] ..... B26B 29/02

[52] U.S. Cl. ..... 224/232; 224/253; 224/904

[58] Field of Search ..... 224/232, 242, 249, 252, 224/253, 909; 30/151, 153, 158, 159

[56] References Cited

U.S. PATENT DOCUMENTS

| | | | |
|---|---|---|---|
| 2,098,678 | 11/1937 | Schrade | 30/159 |
| 2,530,236 | 11/1950 | Erickson | 30/159 |
| 4,261,103 | 4/1981 | Heck | 30/159 |
| 4,426,779 | 1/1984 | Morgan | 30/158 X |
| 4,494,309 | 1/1985 | Gray | 224/232 X |
| 4,494,310 | 1/1985 | Slaughter | 30/151 X |
| 4,525,928 | 7/1985 | Foster | 224/232 X |

*Primary Examiner*—Stephen Marcus
*Assistant Examiner*—Robert Petrik
*Attorney, Agent, or Firm*—Harvey B. Jacobson

[57] ABSTRACT

A holster for suspending a folding knife from a wearer's belt is of elongated C-shaped form. The holster has end portions for gripping the ends of the knife, a spine portion against which the knife blade can be folded when inserting the knife in the holster, and a blade catch which fits between the blade and the knife body. When the knife body is pulled from the holster the catch presses against the blade thereby unfolding the knife. The knife fits in the holster with the blade pointing down, and the holster has an opening aiding discharge of foreign material therefrom. A spring detent in one end portion of the holster allows knives of somewhat different length to be accommodated.

9 Claims, 3 Drawing Figures

KNIFE HOLSTER

BACKGROUND OF THE INVENTION

This invention relates to a knife holster which may, for example, be worn on a belt, the holster being suitable for holding a folding knife, such as a hunting knife with a spring blade, in a manner whereby removal of the knife from the holster is effective in opening the blade so that the knife is ready for immediate use without having to open the blade in a separate operation.

STATEMENT OF PRIOR ART

The following U.S. patents disclose various forms of knife holders, scabbards and the like. None of these, however, discloses a holster having the features of the present invention.

U.S. Pat. No. 2,261,267
U.S. Pat. No. 2,767,530
U.S. Pat. No. 3,958,330
U.S. Pat. No. 4,122,984
U.S. Pat. No. 4,152,831
U.S. Pat. No. 4,426,779

SUMMARY OF THE INVENTION

In accordance with the invention, a holster for a knife having a body member and a folding blade comprises a sheath generally in the form of an elongated C having end portions formed for gripping the ends of the knife body member when the knife is inserted in the holster. Internally, the holster includes a blade catch for fitting between a tip end portion of the knife blade and the body member is gripped in the holster, the catch preventing the blade from closing completely and also pressing against the blade when the body member is pulled out of the holster so as to unfold the knife. The holster may further include a spine portion against which the knife blade can be folded when inserting the knife in the holster.

Preferably, the knife fits in the holster with the blade pointing down and the holster may have an opening aiding discharge of foreign material therefrom, the opening being defined between the spine portion and the blade catch. A spring detent may be provided in one end portion of the holster so as to accommodate knives of somewhat different length.

Holsters in accordance with the invention allow folding knives to be inserted therein and removed therefrom one-handed in a single motion which is effective also to fold or unfold the knife as the case may be.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
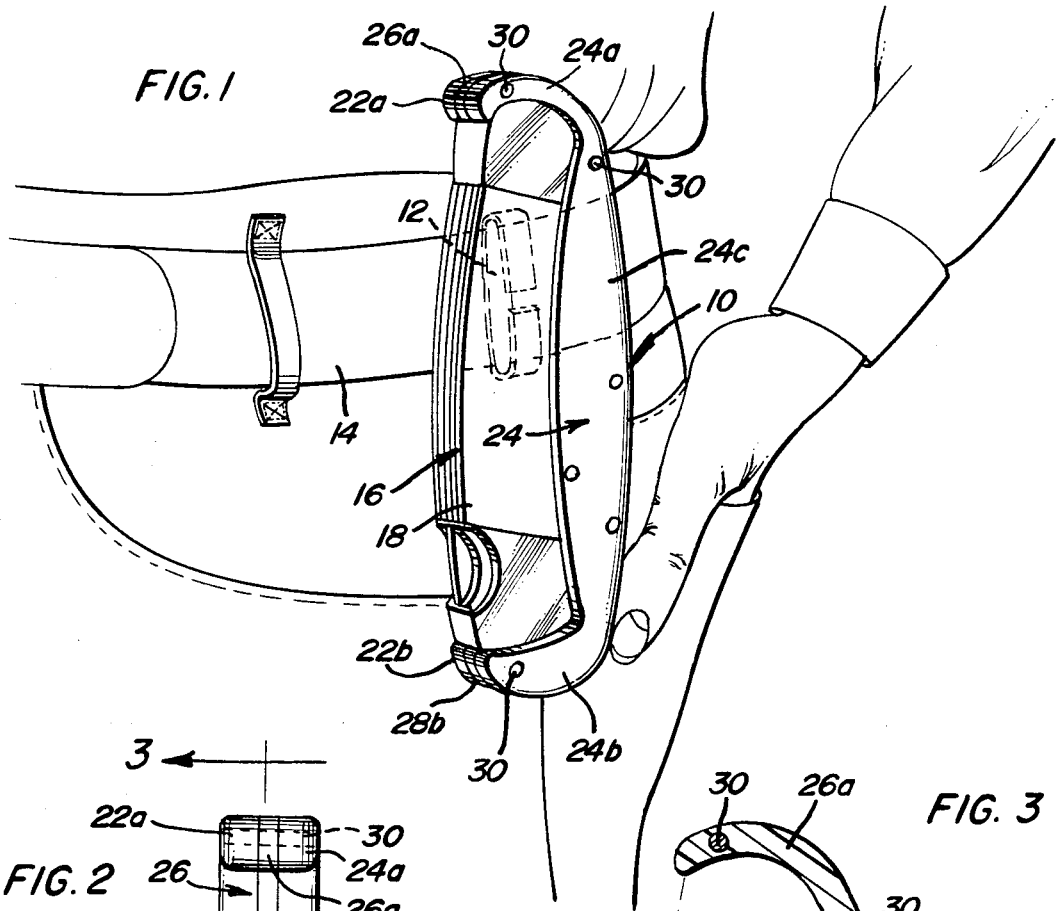
FIG. 1 is a perspective view of a holster in accordance with the invention shown in position on a wearer's belt, with a hunting knife located in the holster.
Figure 2:
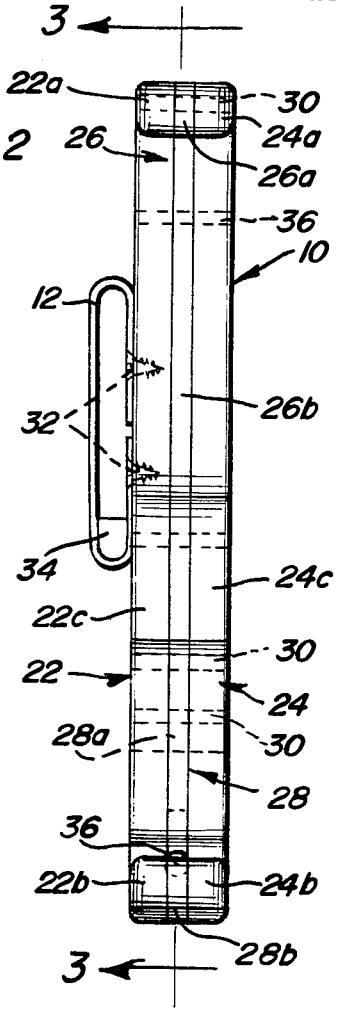
FIG. 2 is a front elevational view of the holster.

Referring initially to FIG. 1, there is illustrated a holster 10 mounted through a loop 12 on a wearer's belt

Figure 3:
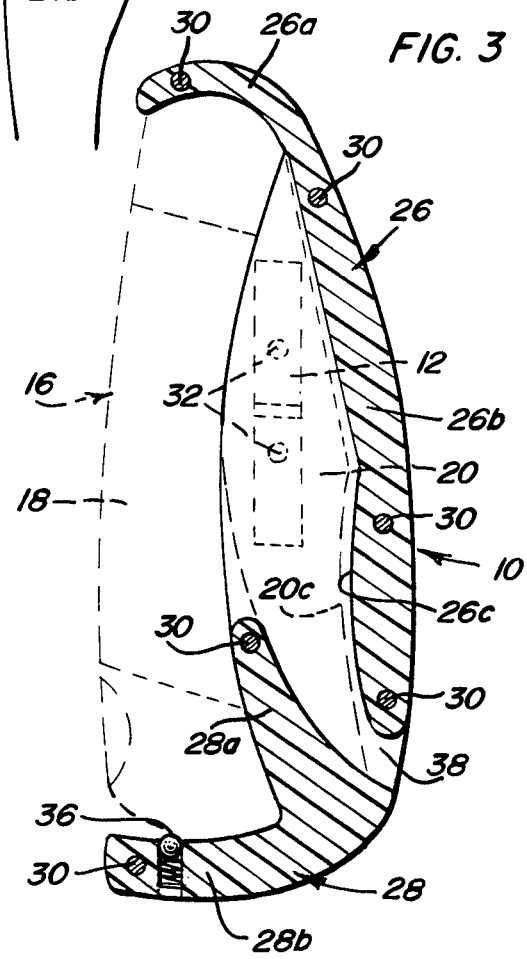
FIG. 3 is a sectional view on line 3—3 of FIG. 2 with the knife shown in phantom.

14, the holster receiving a folded hunting knife 16. As shown in phantom in FIG. 3, the knife, which may be a Buck Hunter Model No. 110 for example, has a body member 18 and a spring folding blade 20. The design of the holster, as will be described, allows the wearer to remove the knife with one hand, the action of which is accompanied by automatic opening of the knife blade, and also allows the wearer to holster the knife with one hand and with the blade open, which action is accompanied by folding of the blade.

Holster 10, which is in the form of a sheath or casing, comprises a pair of side members 22, 24, which may be of brass or other suitable metal or like material, each being shaped generally in the form of an elongate C, the side members having spacer members 26, 28 of Nylon or other similar material located therebetween, and the side members and spacer members being interconnected by rivets 30. Belt loop 12, which may be of thin metal sheet, may be secured to side member 22 by screws 32 and may be provided with a removable plastic spacer 34, or spacers, for sizing the loop accurately to fit the wearer's belt.

Spacer member 26 has an upper arched portion **26*a* conforming to the shape of the corresponding upper portions 22*a*, 24*a* of the side members, and an elongate substantially vertical portion 26*b* forming a spine at the back of the holster. The inner surface 26*c* of the spine may be shaped to fit the corresponding outer edge 20*c* of blade 20**.

Spacer member 28 has a base portion **28*b* conforming generally to the shape of the corresponding base portions 22*b*, 24*b* of the side members, and an upwardly extending ramp-like portion 28*a* forming a blade catch as will be described. Base portion 28*b* is provided with a spring detent ball 36 for accommodating variations in the length of knives inserted in the holster. A space 38 is provided between spacer members 26 and 28**.

The height between the upper portion and base portion of the holster, and the shape of these portions are such as to frictionally grip the ends of the knife body member 18, which action is enhanced by ball 36. In order to holster the knife with its blade open, the blade is inserted in the holster and pressed against spine portion **26*b* of spacer 26 with a downward sliding motion, while hinging body member 18 of the knife downwardly to fold the body portion into the holster and snap its ends into gripping engagement between the upper and base portions of the holster. In this condition of the knife (FIG. 3) the blade catch portion 28*a* of spacer 28 fits between the tip end of blade 20 and body member 18 of the knife, preventing the blade from closing completely, so that the spring closing force of the blade acting against catch portion 28*a* further aids in retaining the knife in the holster. Thus, the holster retains the knife with the blade pointing down and with its tip in the region of opening 38 which aids in discharging foreign material from the holster. The side members have body portions 22*c*, 24*c* which may be shaped to cover the knife blade while leaving the body member 18** substantially exposed.

To remove the knife from the holster, it is only necessary to pull outwardly on body member 18, and the pressure of blade 20 against catch portion **28*a* will automatically unfold the knife, so that it is ready for immediate use. Both insertion of the knife into the holster and removal therefrom accompanied by folding or unfolding of the blade can be done with one hand. In order to ensure that the holster is worn correctly for receiving the knife with the blade pointing down, which is safer and promotes discharge of foreign material, belt loop 12** may be positioned closer to the top of the holster.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holster for a knife having a body member and a folding blade, the holster comprising a sheath formed with means for gripping the ends of the body member when the blade is folded, and a blade catch for fitting between a tip end portion of the blade and the body member when the body member is gripped in the sheath, so as to prevent the blade from closing completely, and the catch pressing against the blade when the body member is pulled out of the sheath so as to unfold the knife, wherein the sheath includes a spine member against which an outer edge of the knife blade may be pressed when inserting the knife in unfolded condition into the sheath to provide a reaction surface for folding the knife by hinging the body member relative to the blade and wherein the sheath defines an opening at one end of said spine member adjacent the blade catch to aid discharge of foreign material from the knife when it is inserted in the sheath with the tip portion of the blade pointing downwards.

2. The invention of claim 1 including mounting means for attaching the sheath to an article of clothing and the like in a manner promoting insertion of a knife into the sheath with the tip portion of the blade pointing down.

3. The invention of claim 2 wherein the mounting means comprises a belt loop located on the sheath adjacent one end thereof opposite said opening and catch.

4. The invention of claim 1 wherein the gripping means includes a spring detent means for accommodating knives of different length.

5. A holster for a knife having a body member and a folding blade, the holster comprising a sheath having means for gripping the ends of the body member when the blade is folded, means providing a reaction surface against which an outer edge of the knife blade may be pressed when inserting the knife into the holster in an unfolded condition, to allow folding of the knife by hinging of the body member relative to the blade, sliding of the blade along said surface and pressing of the body member into said gripping means, the sheath further including a blade catch positioned between a tip portion of the blade and the body member of the knife when the body member is gripped by the gripping means, the catch pressing against the blade when the body member is pulled out of the gripping means so as to unfold the knife, wherein the sheath is generally in the form of an elongate C with opposite end portions thereof defining the gripping means, spine portion thereof between the end portions defining said reaction surface, and said catch being located inwardly of the spine portion adjacent one of said end portions of the sheath, wherein the sheath comprises interconnected C-shaped side members with spacer means therebetween defining said spine portion and said catch and wherein the spacer means comprises a first spacer member defining the spine portion, and a second spacer member defining the catch, with an opening formed between the spacer members for the discharge of foreign material from the holster.

6. The invention of claim 5 wherein the second spacer member comprises a base portion and a ramp portion extending upwardly from the base portion, the ramp portion defining the catch.

7. The invention of claim 6 wherein the base portion of the second spacer member includes a spring detent to facilitate gripping knives of different length in the sheath.

8. The invention of claim 5 including mounting means on the sheath for attaching same to an article of clothing or the like, the mounting means being located towards one end of the sheath opposite the catch and opening so that a knife is inserted into the sheath with the tip portion of the knife blade pointing down.

9. The invention of claim 5 in combination with a folding knife, wherein the reaction surface is shaped substantially in conformance with the outer edge of the knife blade.

* * * * *